United States Patent [19]

Rohner

[11] 4,065,073

[45] Dec. 27, 1977

[54] CREEL CARRIAGE

[75] Inventor: Joachim Rohner, Monchen-Gladbach, Germany

[73] Assignee: W. Schlafhorst & Co., Monchen-Gladbach, Germany

[21] Appl. No.: 711,080

[22] Filed: Aug. 2, 1976

[30] Foreign Application Priority Data

Jan. 8, 1975 Germany ..... 2534507

[51] Int. Cl.[2] ..... B65H 49/02; D02H 1/00; D03J 5/08

[52] U.S. Cl. ..... 242/131; 66/145 S

[58] Field of Search ..... 242/131, 131.1, 147 A, 242/18 AA, 35.6 E; 139/256 A; 57/34 B, 34 TT, 34.5; 66/145 S; 226/97

[56] References Cited

U.S. PATENT DOCUMENTS

| | | | |
|---|---|---|---|
| 2,710,155 | 6/1955 | Borges, Jr. | 242/131.1 |
| 3,257,083 | 6/1966 | Furst | 57/34.5 |
| 3,718,270 | 2/1973 | Parmegiani et al. | 226/97 |

*Primary Examiner*—Leonard D. Christian
*Attorney, Agent, or Firm*—Herbert L. Lerner

[57] ABSTRACT

A creel carriage for warping creels having a plurality of spikes for receiving thereon textile coils constructed as hollow members, the spikes being constructed at the tips thereof as thread suction nozzles and being connectible to a negative pressure-generating pneumatic device.

5 Claims, 2 Drawing Figures

CREEL CARRIAGE

The invention relates to a creel carriage for warping creels with textile coil arbors or spikes constructed as hollow members.

Before the creel carriage is driven into the warping creel, the starting end of the threads of the textile coils or bobbins must be made ready so that it can be gripped reliably and quickly, especially by suction grippers of an automatic knotter. In heretofore known creel carriages, the thread starting end is made ready either by looping it around the specially shaped tip of the arbor or spike or by clamping it in a clamping device at the tip of the arbor.

In this connection, it is disadvantageous that, because of the different length of the thread starting end, either thread loops of different size arise between the bobbin and the clamping point, or excess thread ends of different length. In either case, this interferes particularly with a subsequent automatic tying operation. Cutting off the excess thread length in order to avoid these disadvantages leads to a lengthening of the make-ready time. It is furthermore disadvantageous that the conventional make-ready operation is very time-consuming.

It is accordingly an object of the invention to provide a creel carriage which avoids the foregoing disadvantages. With the foregoing and other objects in view there is provided in accordance with the invention, in a creel carriage for warping creels having a plurality of mounting arbors or spikes for receiving thereon textile coils constructed as hollow members, the spikes being constructed at the tips thereof as thread suction nozzles and being connectible to a negative pressure-generating pneumatic device.

After the textile coils are slipped onto the arbors or spikes, the pneumatic device is set at underpressure or negative pressure. The thread starting ends are held in front of the arbor tip and drawn to about the same shape and length of the thread loop because of the uniform underpressure.

In accordance with another feature of the invention, the creel carriage has a frame constructed of tubular conduit or pipe forming a connecting line from the arbors or spikes to the pneumatic device. Although creel carriages have been provided heretofore with frames formed of tubes, these tubes are used, however, merely to save weight and because of their attractive appearance. The frame parts also have cutouts and openings but only where necessary for welding them together. Otherwise, the tubular frame parts of heretofore known creel carriages are not constructed as conduit or pipe frames i.e. with a pneumatically conducting connection of the individual frame parts one with the other. Also, the arbors or spikes that were constructed as hollow members have heretofore not been connected pneumatically conductively with the frame.

The pneumatic device remains connected at least long enough that the thread starting ends of all the textile coils are sucked in and made ready. The tying operation of an automatic knotter is facilitated if the pneumatic device is, in addition, set to underpressure or negative pressure and remains connected until all the thread starting ends have been seized, severed and knotted or tied.

In accordance with a further feature of the invention and in order that relatively longer thread starting ends might not be sucked too far into the tubular frame, thread screens are disposed in the interior of the hollow spikes or arbors.

The thread starting end is collected in front of the thread screens in the form of a ball. This ball remains in the arbor or spike if the thread loop is seized, for example, by the thread gripper of an automatic knotter and the thread is severed in the course of the tying operation. After the threads have run off or been unwound from the bobbins, and the creel carriage has been driven out of the warping creel for renewed make-ready, in accordance with an added feature of the invention, the arbors and/or the thread screens, after the pneumatic flow direction is reversed, can be blown out for the cleaning screens. In this regard, the pneumatic device can be placed in operation again and set to overpressure or excess pressure. One or more pressure blasts blow out the thread balls that have collected in front of the screens.

The advantages deriving from the invention of the instant application are, in particular, that slipping new bobbins onto the arbors or spikes and making the thread starting ends ready proceed much faster than in heretofore known creel carriages, and that the thread starting ends can be seized or gripped with less trouble, especially by automatic devices.

Other features which are considered as characteristic for the invention are set forth in the appended claims.

Although the invention is illustrated and described herein as embodied in creel carriage, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
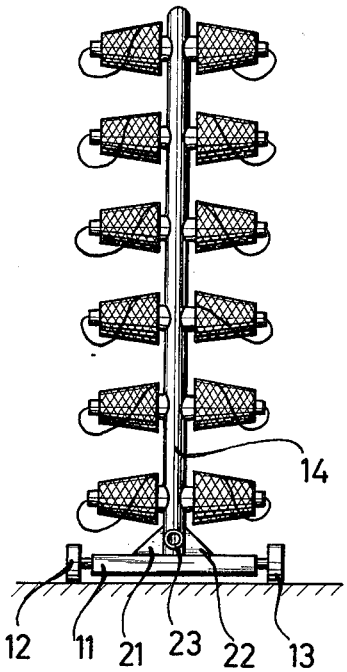
FIG. 1 is a diagrammatic front elevational view of a creel carriage constructed in accordance with the invention.
Figure 2:
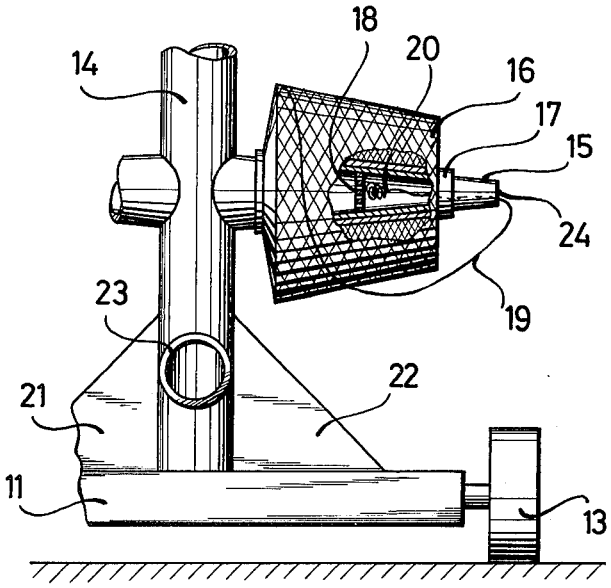
FIG. 2 is an enlarged fragmentary view of the creel carriage of FIG. 1, shown partly broken away and partly in section.

Referring now to the figures of the drawing, there is shown therein a creel carriage having a chasis or undercarriage 11, to which rollers 12 and 13 are attached. The chassis 11 carries a tubular conduit or pipe frame 14, to which a multiplicity of identical arbors or spikes 15, constructed as hollow members, is fastened. The arbors 15 are connected to the pipe frame 14 so as to be pneumatically conducting. A textile coil or bobbin 16 having an associated coil core 17 is slipped onto each arbor 15, as shown in FIG. 2. In the interior of the arbors or spikes 15, thread screens 18 are disposed, in front of which the thread starting ends 19 of the textile coils 16, after they have been sucked up, collect to form a more-or-less large ball 20, depending upon the length of the thread starting end. The tubular conduit or pipe frame 14 is braced by support plates 21 and 22 against the chassis or undercarriage 11. The frame 14 is connectible by means of a pipe stub 23 to a non-illustrated conventional pneumatic supply device, for example, via a flexible line.

As soon as all the textile coils are slipped on the arbors or spikes 15, the pneumatic device is connected to the pipe inlet stub 23 and set at underpressure or negative pressure. Then, the thread starting ends 19 are held in front of the arbor tip, which is constructed as a thread suction nozzle 24, and sucked up to the front of the thread screen 18. As soon as all the thread starting ends 19 are sucked up, the creel carriage is pushed into the warping creel for further use.

There are claimed:

1. In a creel carriage for warping creels, a plurality of spikes formed as hollow members for receiving textile coils thereon, the spikes having at the tips thereof respective suction nozzles for sucking the end of a thread wound on a respective textile coil into the hollow spike, and means for connecting the hollow spikes to a negative pressuregenerating pneumatic device.

2. Creel carriage according to claim 1, comprising a frame formed of tubular conduit, said spikes being mounted on said frame and forming a connecting line therewith to the pneumatic device.

3. Creel carriage according to claim 1, including thread screens disposed in the interior of the hollow spikes.

4. Creel carriage according to claim 3 in combination with means for generating a positive pneumatic pressure, said connecting means being connected to said positive-pressure generating means for blowing out said thread screens.

5. Creel carriage according to claim 1 in combination with means for generating a positive pneumatic pressure, said connecting means being connected to said positive-pressure generating means for blowing out the spikes.

* * * * *